United States Patent [19]

Hanyu

[11] Patent Number: 4,584,956

[45] Date of Patent: Apr. 29, 1986

[54] ARRANGEMENT OF PATTERN INDICATION IN A PATTERN SELECTING DEVICE OF A SEWING MACHINE

[75] Inventor: Susumu Hanyu, Tokyo, Japan

[73] Assignee: Janome Sewing Machine Co., Ltd., Tokyo, Japan

[21] Appl. No.: 644,127

[22] Filed: Aug. 23, 1984

[30] Foreign Application Priority Data

Aug. 23, 1983 [JP] Japan ..... 58-129341[U]

[51] Int. Cl.[4] ..... D05B 3/02

[52] U.S. Cl. ..... 112/444; 112/458; 340/365 E

[58] Field of Search ..... 112/158 E, 158 F, 158 R, 112/158 B, 158 D, 121.11, 121.12, 444, 458, 453; 200/5 A, 5 R, 317, 314, 310, 307; 340/365 R, 365 C, 365 E; 307/115, 113

[56] References Cited

U.S. PATENT DOCUMENTS

| | | | |
|---|---|---|---|
| 4,181,086 | 1/1980 | Takenoya et al. | 112/158 E X |
| 4,199,751 | 4/1980 | Piguet | 340/365 R |
| 4,242,667 | 12/1980 | Hunts | 340/365 E X |
| 4,360,716 | 11/1982 | Fiorella | 200/5 A |
| 4,373,459 | 2/1983 | Dunn et al. | 112/158 E |

*Primary Examiner*—Peter Nerbun

*Attorney, Agent, or Firm*—Michael J. Striker

[57] ABSTRACT

A pattern indication arrangement for a pattern selecting device, that is operated by finger-pushing, of a sewing machine, is comprised of a plurality of shorter rectangular pattern indicators; a plurality of longer rectangular pattern indicators, and located on each indicator for actuating the indicators when pushed. Each element is projected from each of the indicators, the shorter rectangular pattern indicators and the longer rectangular pattern indicators are arranged adjacent to each other in longitudinal and transverse directions in alignment with each other in the alternate rows.

4 Claims, 11 Drawing Figures

ARRANGEMENT OF PATTERN INDICATION IN A PATTERN SELECTING DEVICE OF A SEWING MACHINE

FIELD OF THE INVENTION

This invention relates to arrangement of pattern indications in a pattern selecting device of a sewing machine for selecting stitching patterns by directly finger-pushing a pattern indicator.

BACKGROUND OF THE INVENTION

Prior art embodiments of arrangements of pattern indications in a pattern selecting device of a sewing machine for selecting stitching patterns by directly finger-pushing the pattern indicator will be explained first.

FIG. 1 shows one example of the prior art, in which there are positioned seat switches (not shown) under pattern indicators 1, 1*a* which are sectioned by partitions 2 being higher than the pattern indicators 1, 1*a* so that pushing may be correctly made on the pattern indicators 1, 1*a*. With respect to the long pattern indicator 1*a*, an auxiliary shape 3 is necessary which indicates a position to be pushed. This shape 3 is formed in concave or convex. If pitches between centers to be finger-pushed of the pattern indicators 1, 1*a* are assumed as $P_1$, $P_2$ and $P_3$ respectively, "$P_1$ $P_2$ and $P_3$" is obtained, since the pattern indicators 1, 1*a* are lengthy in longitudinal direction, and $P_1$ should be sized at least the width of finger. Therefore, $P_2$ and $P_3$ become large sized, exceeding the operational necessity.

FIG. 3 shows another example, in which auxiliary shapes 5 are provided to short pattern indicators 4 and long pattern indicators 4*a*, and more accurate operation would be possible in comparison with the case shown in FIG. 1. If the pitches between centers to be finger-pushed are assumed as $P_4$, $P_5$ and $P_6$, these pitches are the same as in FIG. 1, and wasteful areas will be brought about.

FIG. 5 shows a further example, in which if each of pattern indicators 7 is positioned laterally in length, a pitch $P_8$ may be made small in column with respect to a pitch $P_7$ in lateral direction, and this pitch $P_8$ may be made smaller than the pitches $P_2$ ($P_3$) and $P_5$ ($P_6$) in FIGS. 1 and 2. However, since the pattern indicator 7 is shown laterally in length, inconvenience will arise in indication for actually formed stitches, and further since the pitch $P_7$ in the lateral direction requires a certain largeness for easily watching the indicated pattern, its size will exceed the minimum size necessary to the finger-pushing, so that wastefull areas are also brought about.

SUMMARY OF THE INVENTION

In view of the above mentioned difficulties, it is an object of the present invention to provide arrangements of pattern indications in a pattern selecting device for selecting stitching patterns by directly finger-pushing the pattern indicator.

This object is attained by a pattern indication arrangement for a finger-pushing operated pattern selecting device of a sewing machine, comprising a plurality of shorter rectangular pattern indicators; a plurality of longer rectangular pattern indicators; and means located on each indicator for actuating said indicators when pushed, said means including an element projected from each of said indicators, said shorter rectangular pattern indicators and said longer rectangular pattern indicators being arranged adjacent to each other in longitudinal and transverse directions in such a manner that said elements are arranged in alignment with each other in said longitudinal and transverse directions in the alternating rows.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1 to 6 show conventional embodiments, in which

FIG. 1 shows one example of the same,

FIG. 2 is a cross sectional view seen from A—A in FIG. 1,

FIG. 3 shows another example of the same,

FIG. 4 is a cross sectional view seen from B—B in FIG. 4,

FIG. 5 shows a further example of the same,

FIG. 6 is a cross sectional view seen from C—C in FIG. 5,

FIGS. 7 to 10 show embodiments of the invention, in which

FIG. 7 is a plan view showing an arrangement of pattern indication,

FIG. 8 is a plan view showing an arrangement of convexs provided on the pattern indication, FIG. 9 is a cross sectional view seen from D—D in FIG. 8, FIG. 10 is a perspective view of FIG. 8.

DETAILED DESCRIPTION OF THE PREFERRED EMBODIMENT

Figure 1:
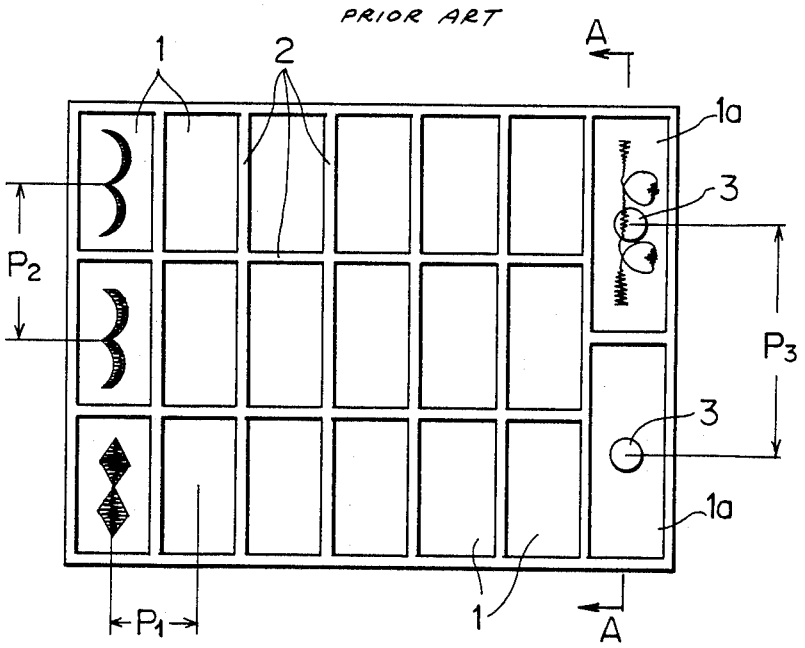
FIG 1 PRIOR ART
Figure 2:
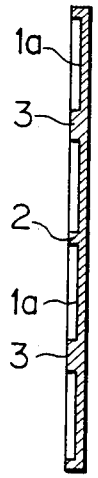
FIG 2 PRIOR ART
Figure 3:
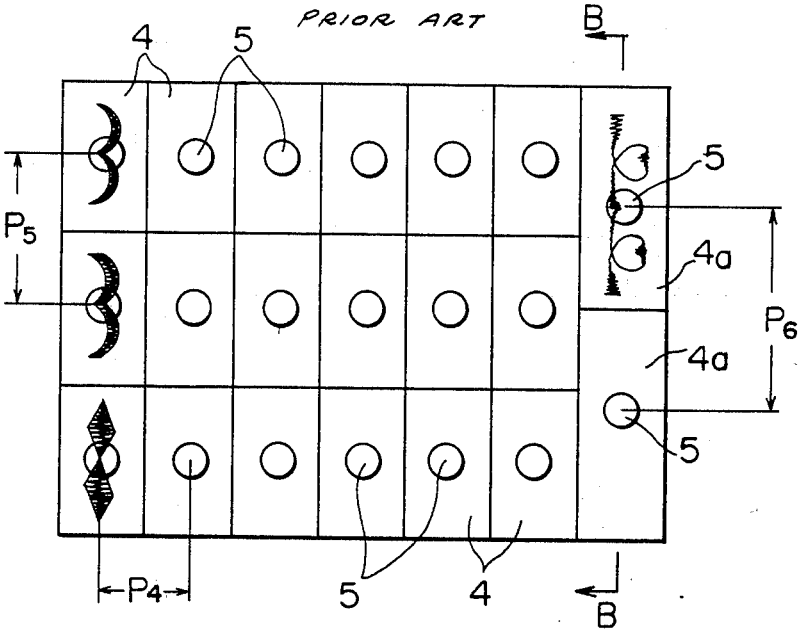
FIG 3 PRIOR ART
Figure 4:
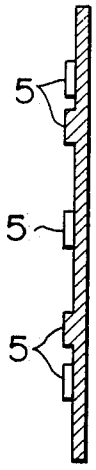
FIG 4 PRIOR ART
Figure 5:
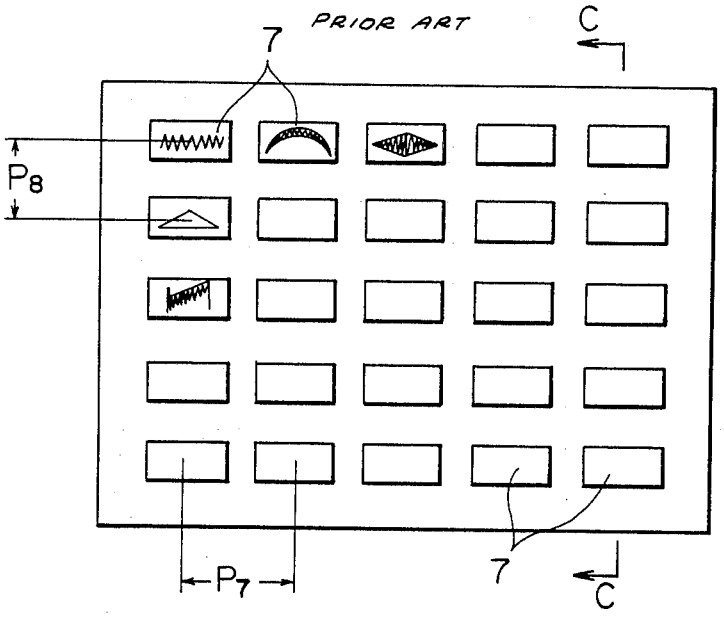
FIG 5 PRIOR ART
Figure 6:
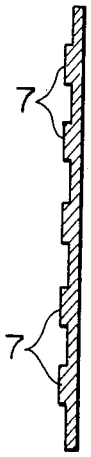
FIG 6 PRIOR ART
Figure 7:
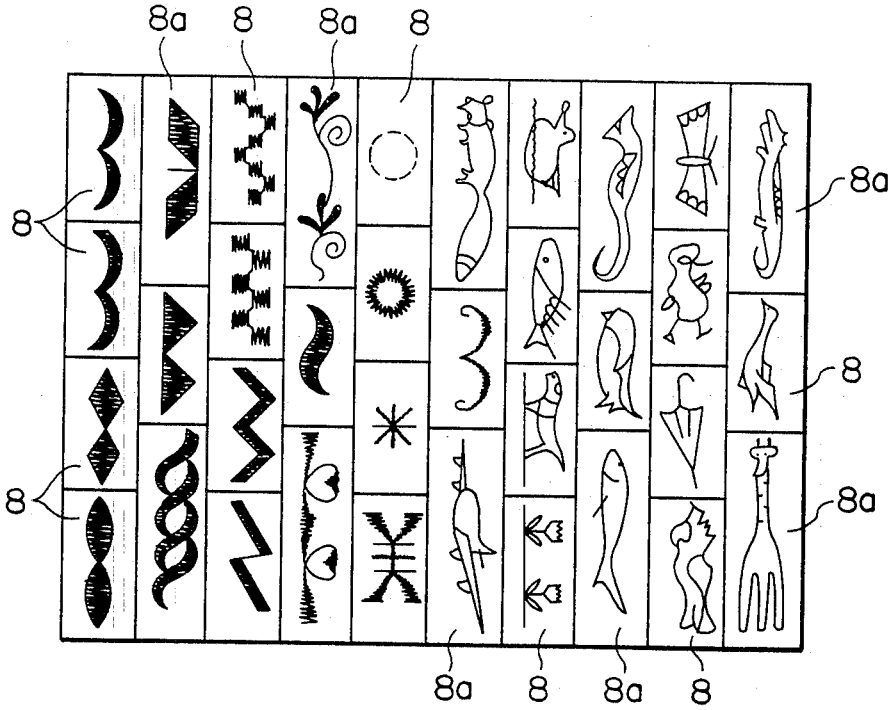

Embodiments of the invention will be explained in reference to FIGS. 7 to 11 of the attached drawings. As is seen in FIG. 7, the pattern indication has two embodiments, one of which is an ordinary pattern indication 8 (called "ordinary indication" hereinafter) which is comparatively shorter in length, and the other of which is a longer pattern indication 8*a* (called "lengthy indication" hereinafter) which is longer than the former 8. It is practically sufficient that the longer indicator 8*a* is 1.5 times of the ordinary indicator 8. FIG. 7 shows an embodiment where the indicators 8, 8*a* are arranged longitudinally.

Figure 8:
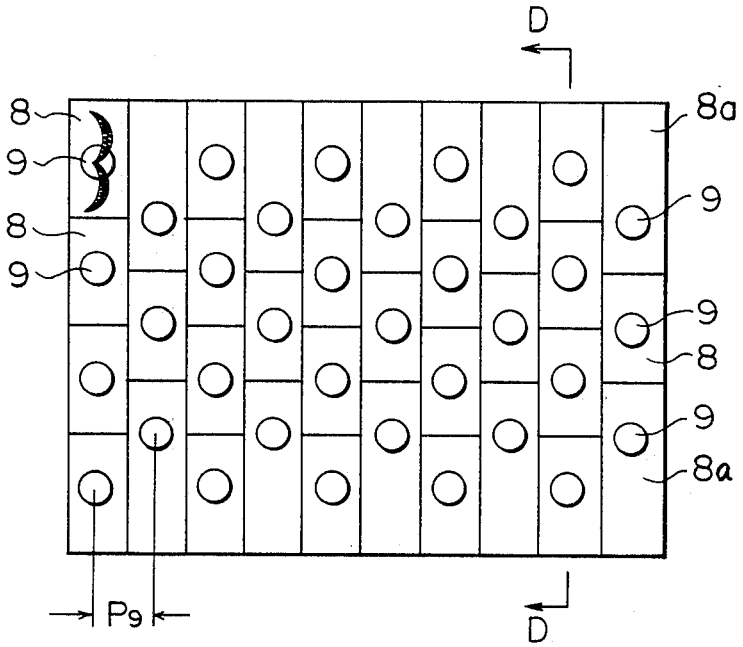
Figure 9:
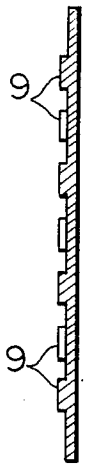
Figure 10:
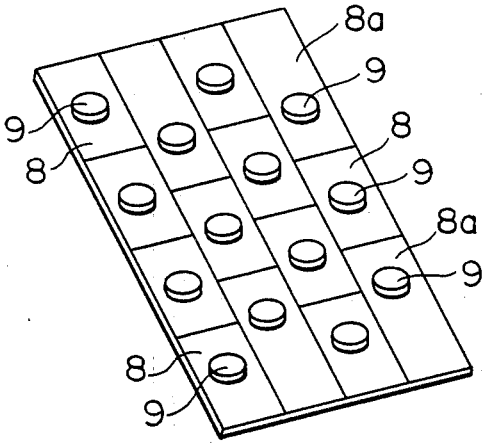

The pattern indicators 8, 8*a* are, as shown in FIGS. 8 to 10, provided thereon with transparent projections or push buttons 9 to be finger-pushed, and switches (not shown) are disposed at corresponding positions under the pattern indicators 8, 8*a*.

According to this embodiment, the longer indicators 8*a* and the ordinary indicators 8 are arranged alternately in a zig-zag pattern such that a lateral arrangement is a row and a longitudinal arrangement is a column.

By making such a zigzag arrangement, a pitch $P_9$ of each of the columns may be reduced to a size less than the width of a finger, so that the pattern indicators may be more gathered.

In the embodiment shown in FIGS. 7 to 10, the lengthy indicators 8*a* are arranged in an alternate column, and the ordinary indicators 8 are arranged therebetween. Assuming that the number of the ordinary indicators 8 between the lengthy indication 8*a* is n (n=0, 1, 2, 3 . . . and in the present example n=1), the number of the ordinary indicators is n+3 (in the present example, 4).

Figure 11:
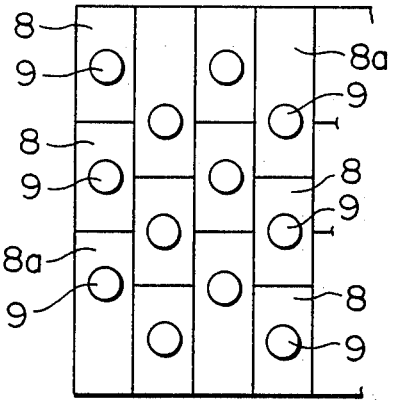
FIG. 11 is a view showing an arrangement of convexs provided on pattern indication relating to the other embodiment than those shown in FIGS. 7 to 10.

For making the zigzag arrangement of the projections 9, there will be supposed a manner for arranging the pattern indications as shown in FIG. 11.

That is, the lengthy indication 8*a* is arranged one per one column at the upper or lower part alternately, and the number of the ordinary indication 8 in each column is m (m=1, 2, 3 . . . and in the example shown in FIG. 11, m=2). Thus the projections 9 are arranged in zigzag, and the same effect as in the embodiment shown in FIGS. 7 to 10 are brought about.

According to the invention, the pattern indications may be more accumulated in the pattern selecting device which selects the stitching patterns by directly finger-pushing the pattern indication.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pattern indication arrangement for a finger-pushing operated pattern selecting device of a sewing machine, the arrangement comprising a plurality of shorter rectangular pattern indicators; a plurality of longer rectangular pattern indicators; and means located on each of said indicators for actuating said indicators when pushed, said means including an element projected outwardly from each of said indicators, said shorter rectangular pattern indicators and said longer rectangular pattern indicators being arranged adjacent to each other in longitudinal and transverse directions of the arrangement in such a manner that the elements on the shorter pattern indicators are in alignment with each other in said longitudinal and transverse directions and the elements on the longer pattern indicators are in alignment with each other in said longitudinal and transverse directions and the elements on the shorter pattern indicators are positioned in alternating rows with the elements on the longer pattern indicators in said longitudinal and transverse directions.

2. A pattern indication arrangement as defined in claim 1 wherein said longer rectangular pattern indicators are 1.5 times the length of said shorter rectangular pattern indicators.

3. A pattern indication arrangement as defined in claim 1, wherein the pattern indicators form two types of columns which are alternately oriented adjacent to one another, one type of column being composed of longitudinally oriented shorter rectangular pattern indicators, and the second type of column being composed of a series of alternating longitudinally oriented shorter rectangular pattern indicators and longer rectangular pattern indicators.

4. A pattern indication arrangement as defined in claim 3, wherein each column has an alternating longitudinal arrangement of shorter rectangular pattern indicators and longer rectangular pattern indicators.

* * * * *